US010463173B2

(12) United States Patent
Robbins et al.

(10) Patent No.: US 10,463,173 B2
(45) Date of Patent: Nov. 5, 2019

(54) PRODUCT PUSHER

(71) Applicant: Beeline Group, LLC, Hayward, CA (US)

(72) Inventors: Gary Robbins, Aptos, CA (US); Steven Resnick, Pleasanton, CA (US); Miguel Anaya, San Francisco, CA (US); Rafael Rivera, Livermore, CA (US); Jon Michael Ringham, Suwanee, GA (US)

(73) Assignee: Beeline Group, LLC, Hayward, CA (US)

( * ) Notice: Subject to any disclaimer, the term of this patent is extended or adjusted under 35 U.S.C. 154(b) by 0 days.

(21) Appl. No.: 15/648,129

(22) Filed: Jul. 12, 2017

(65) Prior Publication Data

US 2019/0014923 A1 Jan. 17, 2019

(51) Int. Cl.

| | |
|---|---|
| ***A47F 1/12*** | (2006.01) |
| ***A47F 5/00*** | (2006.01) |
| ***A47F 7/00*** | (2006.01) |

(52) U.S. Cl.

CPC ..... *A47F 1/126* (2013.01); *A47F 5/005* (2013.01); *A47F 7/0007* (2013.01)

(58) Field of Classification Search

CPC .. A47F 1/12; A47F 1/125; A47F 1/126; A47F 5/005; A47F 5/0043; A47F 7/7007; A47B 57/583; A47B 57/588

USPC ..... 211/59.3

See application file for complete search history.

(56) References Cited

U.S. PATENT DOCUMENTS

| | | | | |
|---|---|---|---|---|
| 2,934,212 | A * | 4/1960 | Jacobson | A47F 1/121 211/59.3 |
| 5,634,564 | A * | 6/1997 | Spanner | A47F 1/126 211/175 |
| 6,464,089 | B1 * | 10/2002 | Rankin, VI | A47F 1/126 211/59.3 |
| 6,523,703 | B1 * | 2/2003 | Robertson | A47F 1/126 211/51 |
| 7,028,852 | B2 * | 4/2006 | Johnson | A47F 1/126 108/60 |
| 8,172,094 | B2 * | 5/2012 | Meyer | A47F 5/005 211/134 |
| 2001/0010302 | A1 * | 8/2001 | Nickerson | A47F 1/126 211/59.3 |
| 2002/0170866 | A1 * | 11/2002 | Johnson | A47F 1/126 211/59.3 |
| 2004/0140278 | A1 * | 7/2004 | Mueller | A47F 1/126 211/59.3 |
| 2005/0092703 | A1 * | 5/2005 | Mueller | A47F 1/126 211/59.3 |
| 2005/0218094 | A1 * | 10/2005 | Howerton | A47F 1/126 211/59.3 |

(Continued)

*Primary Examiner* — Patrick D Hawn

(74) *Attorney, Agent, or Firm* — Sheppard, Mullin, Richter & Hampton LLP

(57) ABSTRACT

A system for pushing products for purposes of dispensing the products. Systems can include a base track, a fence tracker, a rear cap, and a rounded front guard that define a product containment channel for containing products in a queue for dispensing. Systems can also include a pusher mechanism for applying a constant and substantially uniform force to a product to push the product towards a rounded front guard where it can be dispensed.

19 Claims, 18 Drawing Sheets

(56) References Cited

U.S. PATENT DOCUMENTS

| | | | | |
|---|---|---|---|---|
| 2006/0163272 | A1* | 7/2006 | Gamble | A47F 1/126 221/227 |
| 2006/0186066 | A1* | 8/2006 | Johnson | A47F 1/126 211/59.3 |
| 2006/0237381 | A1* | 10/2006 | Lockwood | A47F 1/126 211/59.3 |
| 2007/0267364 | A1* | 11/2007 | Barkdoll | A47F 1/126 211/59.3 |
| 2010/0258513 | A1* | 10/2010 | Meyer | A47F 1/126 211/59.3 |
| 2011/0315706 | A1* | 12/2011 | Lockwood | A47F 1/126 221/155 |
| 2014/0117818 | A1* | 5/2014 | Dipaolo | A47F 3/002 312/139 |
| 2015/0060480 | A1* | 3/2015 | Lockwood | A47F 1/126 221/279 |
| 2018/0000262 | A1* | 1/2018 | Pritchard | A47F 1/126 |

* cited by examiner

PRODUCT PUSHER

DETAILED DESCRIPTION

Figure 1:
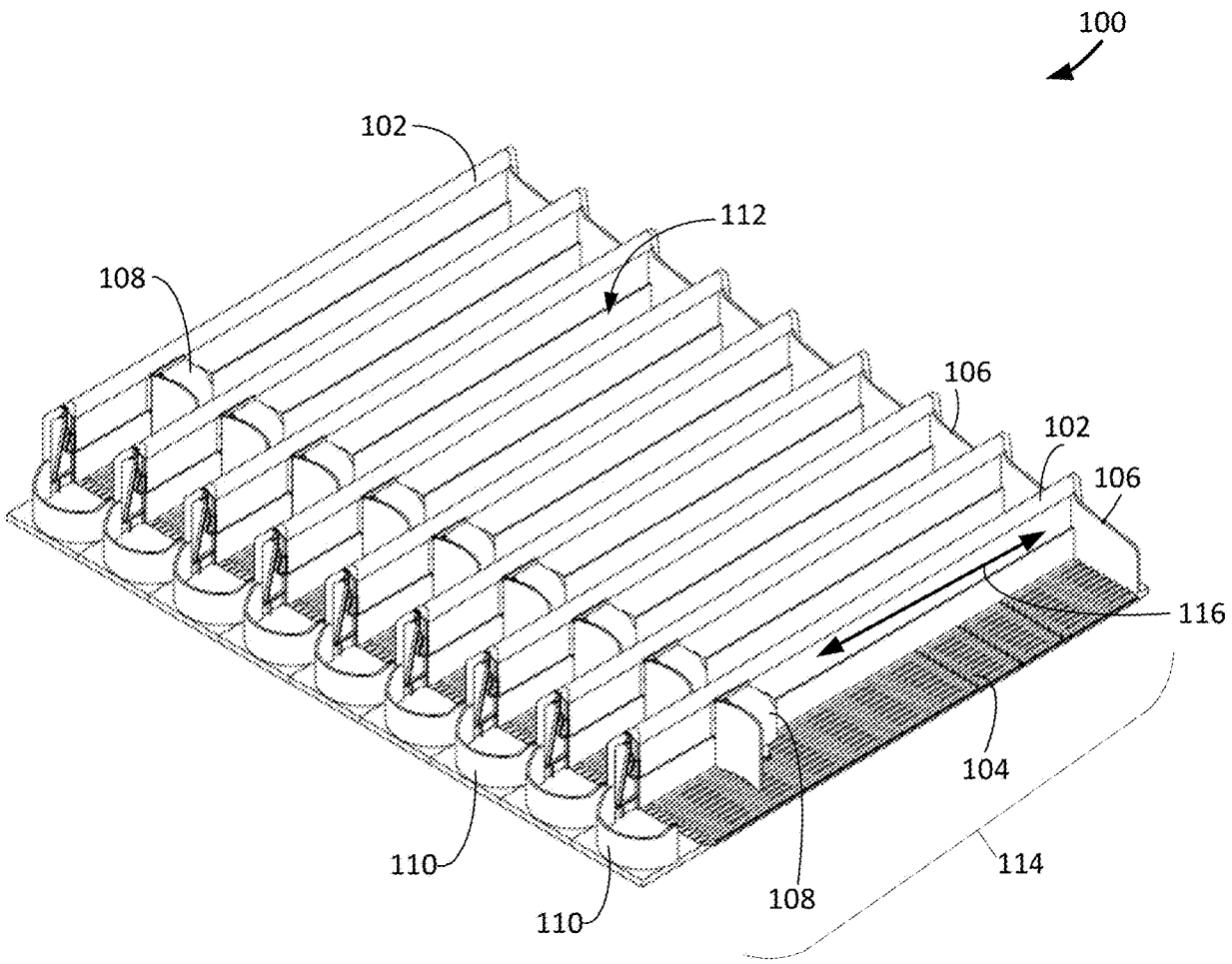
FIG. 1 depicts a perspective view of an example of a product pusher system.

FIG. 1 depicts a perspective view 100 of an example of a product pusher system. The product pusher system shown in FIG. 1 can be configured to push a product for purposes of dispensing the product to a consumer. More specifically, the product pusher system can be included as part of a vending machine, shelf unit, or other automated mechanism configured to dispense a product to a consumer, potentially in exchange for money or another applicable form of consideration. A product pushed by the product pusher system can include an applicable physically tangible item capable of being utilized by a consumer. For example, a product pushed by the product pushed system shown in FIG. 1 can include a consumer electronic item, a beverage, or a packaged food item. The product pusher system shown in FIG. 1 can be configured to push a product to cause dispensing of the product through application of a force to one or a plurality of products to cause pushing of one or a plurality of products for dispensing. For example, the product pusher system shown in FIG. 1 can be configured to apply a force to an end product in a queue of a plurality of products. Further in the example, the force applied to the end product can be translated through the products in the queue to a front product at the front of the queue to cause the front product to be displaced and subsequently dispensed to a consumer.

In a specific implementation, the product pusher system shown in FIG. 1 is tilted within a machine, e.g. a vending machine, or on a shelf incorporating the product pusher system for purposes of dispensing products. More specifically, the product pusher system shown in FIG. 1 can be tilted with respect to a horizontal plane of a ground upon which a structure incorporating the product pusher system is placed. For example, the product pusher system shown in FIG. 1 can be tilted towards a front of a shelf incorporating the product pusher system. By tilting the product pusher system, the force of gravity can be utilized to aid the product pusher system in pushing products for purposes of dispensing the products.

The product pusher system shown in FIG. 1 includes fence trackers 102, base tracks 104, rear caps 106, pusher mechanisms 108, and rounded front guards 110. Each base track 104 extends within a horizontal plane. The plurality of base tracks 102 included as part of the product pusher system shown in FIG. 1 can extend along a plane. The plurality of base tracks 104 included as part of the product pusher system each have a top surface extending along a plane to form at least in part, a product containment channel 112. A product containment channel 112 formed by a top surface of a base track 102 can receive and store products, which can subsequently be pushed out of the product containment channel 112. For example, a product containment channel 112 formed by a top surface of a base track 104 can contain a queue of products onto which a force can be applied to cause one or a plurality of products in the queue to be displaced, or otherwise pushed, and subsequently dispensed using the product pusher system.

In a specific implementation, one or a combination of the base tracks 104 included as part of the product pusher system shown in FIG. 1 can extend along different planes, e.g. substantially parallel planes. More specifically, when the base tracks 104 included as part of the product pusher system extend in different substantially parallel planes, a corresponding top surface of one or a combination of the base tracks 104 can extend along the different substantially parallel planes. In extending along different substantially parallel planes, the base tracks 104 can be used to form, at least in part, product containment channels 112 of differing sizes. For example, a first base track of the base tracks 104 can be positioned in a first plane to create a first product containment channel, while a second base track of the base tracks 104 can be positioned in a second plane beneath the first plane to create a second product containment channel having a greater depth than the first product containment channel. As a result, the product pusher system shown in FIG. 1 can be used to simultaneously contain and subsequently push, potentially simultaneously, products of differing sizes to a consumer.

The fence trackers 102 are coupled to corresponding base tracks 104 and extend along a substantially perpendicular plane with respect to a corresponding plane along which the base tracks 104 extend. For example, a fence tracker 102 and a base track 104 can be connected to create a substantially 90° angle between a side wall of the fence tracker 102 and a top surface of the base track 104. The angle need not be a right angle, though it may be desirable to ensure each angle formed by the fence trackers 102 and the base tracks 104 is roughly the same (or at least changes gradually) to ensure the fence trackers 102 do not lean into and thereby interfere with the product containment channels 112. One or a plurality of fence trackers 102 can connect to a corresponding base track 104 to form a product containment channel. For example, a first fence tracker and a second fence tracker can be connected to a base track and extend out from the base track along planes that are substantially perpendicular to a plane in which the base track extends. Further in the example, a side wall of the first fence tracker, a side wall of the second fence tracker, and a top surface of the base track can define, at least in part a product containment channel for containing and subsequently pushing products using the product pusher system shown in FIG. 1.

The fence trackers 102 extend along corresponding planes that are either substantially parallel to each other or along corresponding planes that intersect with each other, e.g. not parallel to each other. For example, the fence trackers 102 can extend along corresponding planes that intersect to create a product containment channel 112 with a non-uniform width over the height of the product containment channel 112. In another example, the fence trackers 102 can extend along planes that are substantially parallel to each other to create a product containment channel 112 with a substantially uniform width throughout the height of the product containment channel 112. The fence trackers 102 and the base tracks can be positioned and of varying sizes to create product containment channels of varying sizes in the product pusher system shown in FIG. 1. As a result, the product pusher system shown in FIG. 1 can be configured to contain products of different sizes simultaneously and subsequently dispense the different size products, potentially simultaneously.

In a specific implementation, the fence trackers 102 are fabricated from an applicable material and according to an applicable fabrication mechanism to prevent damage to the fence trackers 102 as products are pushed through the product containment channels 112. For example, the fence trackers 102 can be fabricated from aluminum, e.g. over injection molded fence trackers 102, which imbues the fence trackers with adequate strength for certain intended purposes, e.g. dispensing most products that can be removed from the product containment channels 112 by a human of average strength, and thereby decrease damage cause through pushing and subsequently dispensing products through product containment channels formed by the fence trackers. In another example, the fence trackers 102 can be fabricated from a single piece of material to minimize failure points in the fence trackers 102, subsequently preventing damage possibilities of damage to the fence trackers. While utilizing a single piece of material, e.g. aluminum, increases the cost of the fence trackers 102, e.g. by a factor of one third over injection molded plastic fence trackers, tradeoffs in increased durability and reduced possibilities of failure in the use of the fence trackers 102 are achieved.

In a specific implementation, the fence trackers 102 and the base tracks 104 can be sized and positioned to create a product containment channel 112 capable of containing products of a specific size. For example, the fence trackers 102 and the base tracks 104 can be sized and positioned to create product containment channels 112 capable of containing one or a plurality of 12 ounce cans of soda or two-liter soda bottles, or other products for purposes of pushing and subsequently dispensing the products. The base tracks 104 and the fence trackers 102 can be of a length to create product containment channels 112 with a specific channel length 114. For example, the base tracks 104 and the fence trackers 102 can be of a length to create product containment channels 112 with channel lengths 114 between 18 and 22 inches, e.g. 20.5 inches. In another example, the base tracks 104 and the fence trackers 102 can be of a length to create product containment channels 112 with channel lengths 114 between 30 and 40 inches.

The rear caps 106 are configured to define, at least in part, a product containment channel 112 for purposes of pushing the products in the channel 112 to dispense the products. In defining a product containment channel 112, the rear caps 106 can define, at least in part, a channel length 114 of the product containment channel 112. For example, the rear caps 106 can be positioned with respect to the fence trackers 102 and the base tracks 104 to define, at least in part a channel length 114 of a product containment channel 112 at 20.5 inches. The rear caps 106 can be coupled to either or both the fence trackers 102 and the base tracks 104 in defining, at least in part, a product containment channel 112. Further the rear caps 106 can be rigidly secured to either or both the fence trackers 102 and the base tracks 104 to stop movement of products in a queue of products out of the product containment channel 112. More specifically, the rear caps 106 can serve as barrier to prevent overloading of products in a queue of products in a product containment channel 112.

The rounded front guards 110 are configured to define, at least in part a product containment channel 112 for purposes of pushing the products in the channel 112 to dispense the product. In defining a product containment channel 112, the rounded front guards 110 can define, at least in part, a channel length 114 of the product containment channel 112. For example, the rounded front guards 110 can be positioned with respect to the fence trackers 102 and the base tracks 104 to define, at least in part, a channel length 114 of a product containment channel 112 at 20.5 inches. The rounded front guards 110 can be coupled to either or both the fence trackers 102 and the base tracks 104 in defining, at least in part, a product containment channel 112. The rounded front guards 110 can each include a corresponding dispensing pocket for containing a product for purposes of dispensing the product. For example, the rounded front guards 110 can include a corresponding dispensing pocket for containing a front product in a queue of products contained in the product containment channel 112 for purposes of dispensing the front product in the queue of products. A product contained within dispensing pockets of the rounded front guards 110 can be removed from the dispensing pockets using an applicable method or mechanism for moving a product from a dispensing pocket.

In a specific implementation, the rounded front guards 110 are rigidly secured to either or both the fence trackers 102 and the base tracks 104 to stop movement of products in the product containment channels 112 defined, at least in part, by the rounded front guards 110. Specifically, the rounded front guards 110 can be rigidly secured to either or both the fence trackers 102 and the base tracks 104 to stop movement of a front product in a queue of products contained with product containment channels 112 defined, at least in part, by the rounded front guards 110. For example, the rounded front guards 110 can stop a front product in a queue of products contained in the product containment channels 112, as products in the queue of products are displaced towards the rounded front guards 110 in response to a product in the queue of products being dispensed.

The pusher mechanisms 108 are configured to push products in the product containment channels 112 defined, at least in part, by the fence trackers 102 and the base trackers 104 for purposes of dispensing the products. The pusher mechanisms 108 can push products in the product containment channels 112 towards the rounded front guards 110 for purposes of dispensing the products. For example, the pusher mechanism 108 can push a product contained in a product containment channel 112 into a dispensing pocket of a front guard for purposes of dispensing the product by facilitating removal of the product from the dispensing pocket.

The pusher mechanisms 108 are secured to the fence trackers 102 through displacement tracks integrated as part of the fence trackers 102. The displacement tracks are of an applicable shape and design to allow the pusher mechanisms 108 to displace across at least a portion of the channel lengths 114 of the product containment channels 112 along displacement axes 116 while limiting motion of the pusher mechanisms 108 along axes that intersect the displacement axes 116. For example, the displacement tracks of the fence trackers can allow the pusher mechanisms to be displaced towards and away from the rear caps 106 and conversely towards and away from the rounded front guards 110, as part of pushing products towards the rounded front guards 110 for purposes of dispensing the products.

The pusher mechanisms 108 each include one or a plurality of tensioners for use in pushing products in the product containment channels 112 towards the rounded front guards 110 for purposes of dispensing the products. A tensioner, included as part of the pusher mechanism 108, can include an applicable mechanism for generating a force to cause a product to be displaced along a direction within a product containment channel 112. For example, a tensioner can include a wound coil of wire affixed to an anchor point to cause the pusher mechanism 108 to move and subsequently exert a force against a product contained in the product containment channel 112. The tensioner can be included as part of a removable cartridge capable of being attached and detached from a pushing surface as part of a pusher mechanism. A tensioner can be configured to have a specific tension or an adjustable tension to produce forces of different magnitudes for use in pushing different products for purposes of dispensing the products. For example, a specific tensioner can be used to produce a desired force to push a specific product of a certain mass.

In a specific implementation, the pusher mechanism 108 functions to apply a constant substantially uniform force against at least one product contained within the product containment channel 112. A constant substantially uniform force can be applied by the pusher mechanism 108 using tension created by a tensioner included as part of the pusher mechanism. Additionally, a constant substantially uniform force applied by the pusher mechanism 108 can be applied along the displacement axis 116 towards the rounded front guards 110, thereby causing a product to be pushed towards the rounded front guards 110 at a substantially constant velocity. In pushing a product towards the rounded front guards 110 at a substantially constant velocity, the pusher mechanism 108 does not push a product at an ever increasing velocity towards the rounded front guards 110, potentially leading to failure or damage to one or a combination of the rounded front guards 110, the base tracks 104, the fence trackers 102, and the pusher mechanisms 108, or to difficulty loading product into the product containment channels 112.

In a specific implementation, by utilizing a pusher mechanism 108 within the product containment channel 112, three kinematic states are achieved. The first kinematic state is a static state where the product is not moving while the pusher mechanism 108 continues to apply a constant substantially uniform force to the product within the product containment channel 112. For example, a product in static state can be subjected to a constant substantially uniform force applied by the pusher mechanism 108, while a constant substantially uniform force applied by either or both products in a queue of products or the rounded front guards 110 is applied opposing the constant substantially uniform force applied by the pusher mechanism 108. The second kinematic state is a dynamic state in which the product is moving, e.g. at a substantially constant velocity, through the product containment channel in response to a constant substantially uniform force applied by the pusher mechanism 108. For example, a product in a queue of products can be removed from the product containment channel 112 to allow the pusher mechanism to subsequently push another product in the queue of products through the channel 112 through application of a constant substantially uniform force to the another product. The third kinematic state is a dynamic state in which a stocker, which is typically a person, pushes the pusher mechanisms 108 away from the rounded front guards 110, either directly or by pushing on a first of a queue of products between the stocker and the pusher mechanism 108, by exerting force greater than the constant substantially uniform force of the pusher mechanism 108. Typically, the stocker will intermittently load product into the product containment channel 112 and push on the pusher mechanism 108 or the front-most product of a queue of products, thereby pushing back the pusher mechanism 108 as it slowly returns. What is meant by "slowly" is that the pusher mechanism 108 will not immediately return to the first kinematic state as the stocker loads product, but rather will leave sufficient time for the stocker to push back the pusher mechanism 108 and load product in the vacated portion of the product containment channel 112. An advantageous return velocity is one foot (about 30.5 cm) per second or less or, more generally, slower than a spring, but there are additional advantages with respect to stocking to have a return velocity of half that (about 15 cm). In specific implementations, the return velocity is between 1 cm and 8 cm per second. When the stocker is finished loading product, the system returns to the second kinematic state until such time as the products in the product containment channel 112 reach a static state, at which time the system returns to the first kinematic state.

In a specific implementation, the pushing mechanisms 108 are affixed to the fence trackers 102 through displacement tracks that extend substantially halfway between a top and a bottom of the fence trackers 102, e.g. along a central longitudinal axis of the fence trackers 102. In being affixed to the fence trackers 102 through displacement tracks that extend substantially halfway between a top and a bottom of the fence trackers 102, the pushing mechanisms 108 can apply a force to products in a region away from the base tracks 104. This can lead to the pusher mechanisms 108 applying forces to products substantially along displacement axes 116 and not substantially in a direction outward from the product containment channels 112. As a result, products can be efficiently pushed towards the rounded front guards 110 while decreasing risks of pushing products out of the product containment channels 112 before the products are dispensed. Further as a result, products can be efficiently pushed towards the front guards while reducing a force that is applied to the products towards the base tracks 104, thereby increasing friction between the base tracks 104 and the products potentially causing jamming of products within the product containment channels 112 before they are dispensed.

Figure 2:
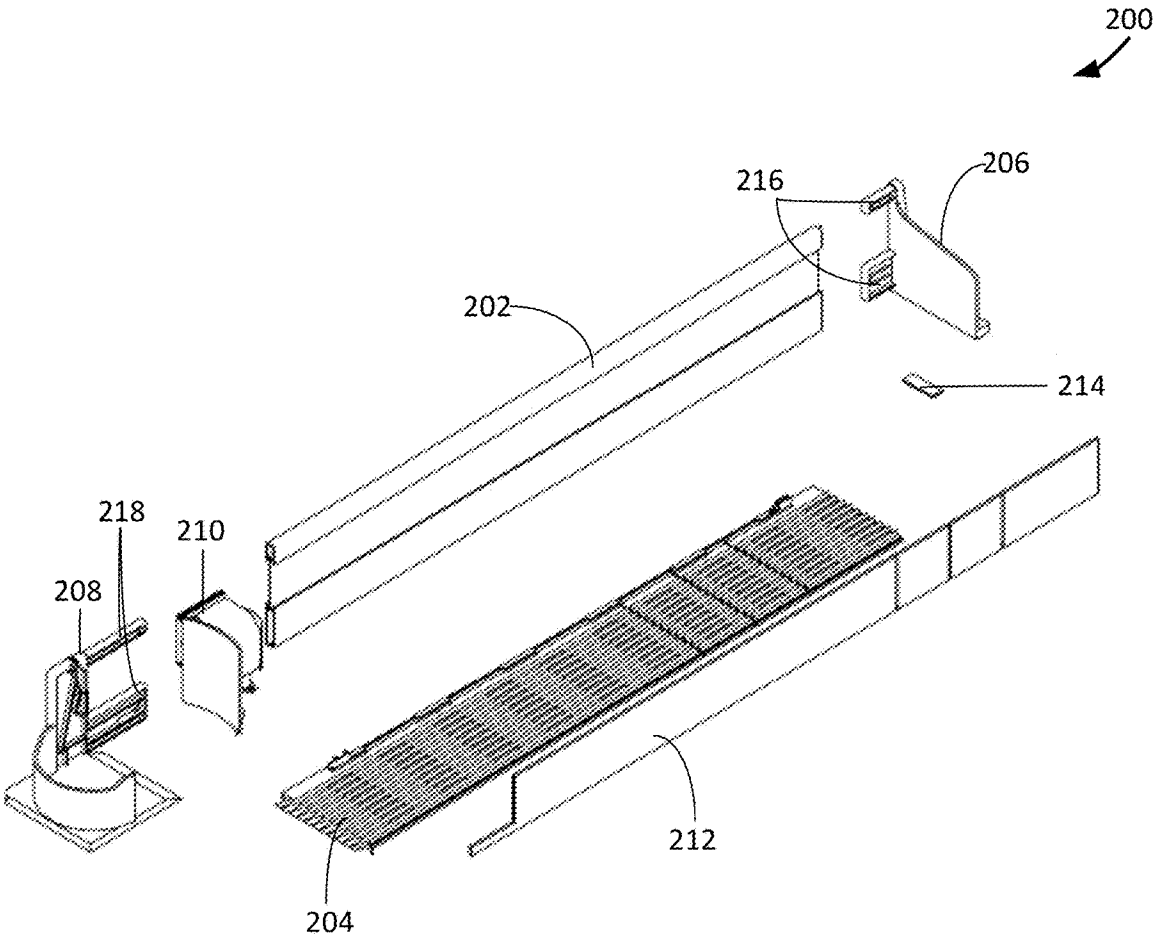
FIG. 2 depicts an exploded perspective view of a product pusher system.

FIG. 2 depicts an exploded perspective view 200 of a product pusher system. The example product pusher system shown in FIG. 2 includes a fence tracker 202, a base track 204, a rear cap 206, a front guard 208, a pusher mechanism 210, an end fence 212, and a rear cap magnet 214. The fence tracker 202 is used in part to form a product containment channel for purposes of containing products capable of being pushed through the channel to dispense the products. Specifically, the fence tracker 202 can form a side of a product containment channel (and potentially sides of two adjacent product containment channels). The base track 204 is used in part to form a product containment channel for purposes of containing products capable of being pushed through the channel to dispense the products. Specifically, the base track 204 can form a bottom of a product containment channel. The rear guard 206 is used in part to form a product containment channel for purposes of containing products capable of being pushed through the channel to dispense the products. Specifically, the rear guard 206 can form a back end of a product containment channel. The front guard 208 is used in part to form a product containment channel for purposes of containing products capable of being pushed through the channel to dispense the products. Specifically, the front guard 208 can form a front end of a product containment channel.

In the example product pusher system shown in FIG. 2, the fence tracker 202, the base track 204, the rear guard 206, and the front guard 208 are coupled to each other to form, at least in part, a product containment channel used in containing products dispensed through pushing of the products. The rear guard 206 is physically coupled to the fence tracker 202 and the base track 204. More specifically, the rear guard 206 can be physically coupled to the fence tracker 202 through one or a plurality of protrusions 216 that extend out from the rear guard 206. The protrusions 216 can be of a size and shape to fit into openings in the fence tracker, to secure the rear guard 206, at least in part, to the fence tracker 202. Additionally, the rear guard 206 can be physically coupled to the base track 204 through the rear cap magnet 214. For example, the rear cap magnet 214 can be glued or otherwise rigidly secured to either the base track 204 or the rear cap 206 to physically connect the base track 204 to the rear cap 206. The front guard 208 is physically coupled to the fence tracker 202. More specifically, the front guard 208 can include one or a plurality of protrusions 218 that extend out from the front guard 208 into openings into the fence tracker 202 to secure the front guard 208 to the fence tracker 202.

The end fence 212 is configured to define, at least in part, a product containment channel for containing products capable of being pushed within the channel for purposes of dispensing the products. The end fence 212 can define a product containment channel along with the fence tracker 202, the base track 204, the rear cap 206, and the front guard 208. In defining a product containment channel, the end fence 212 can be coupled to one or a combination of the base track 204, the rear cap 206, and the front guard 208. Additionally, the end fence 212 can include a protrusion that extends out from the end fence 212 to define a dispensing pocket, with the front guard 208.

The pusher mechanism 210 functions to push products contained in a product containment channel defined by fence tracker 202, the base track 204, the rear cap 206, the front guard 208, and the end fence 212. The pusher mechanism 210 functions to push products in a product containment channel toward a front end of the product containment channel for purposes of dispensing the products. The pusher mechanism 210 can be secured to the fence tracker 202 through a displacement track integrated as part of the fence tracker 202. In being coupled to the fence tracker 202 through a displacement track integrated as part of the fence tracker 202, the pusher mechanism 210 can displace back and forth along at least a portion of the length of the fence tracker 202 to push products towards the front guard 208 for purposes of dispensing the products. The pusher mechanism 210 can include a tensioner including a coil that extends out from the pushing mechanism towards the front guard 208 for purposes of applying a constant substantially uniform force by the pusher mechanism 210 to at least one product contained in a product containment channel. Advantageously, the pusher mechanism 208 returns slowly when it is pushed back by, for example, a stocker, giving the stocker time to load product into a vacated portion of the product containment channel, which is vacated when the stocker pushes the pusher mechanism 208 (and potentially product already in the product containment channel) back.

Figure 3:
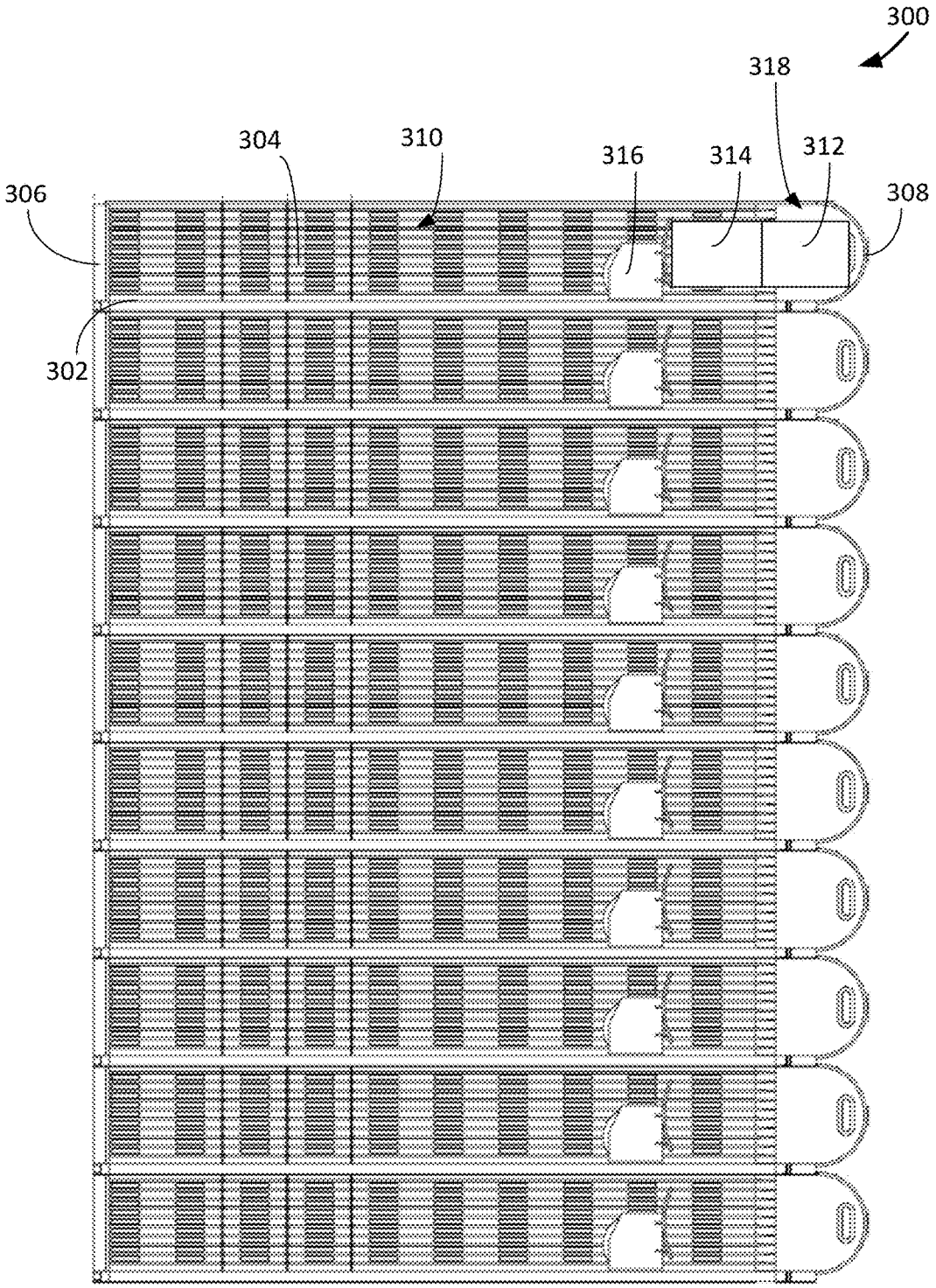
FIG. 3 depicts a top view of a product pusher system.

FIG. 3 depicts a top view 300 of a product pusher system. The example product pusher system shown in FIG. 3 includes a fence tracker 302, a base track 304, a rear cap 306, and a front guard 308. The fence tracker 302, the base track 304, the rear cap 306, and the front guard 308 are coupled to each other to define a product containment channel 310. The product containment channel 310 contains a first product 312 and a second product 314 forming a queue of products.

The example product pusher system shown in FIG. 3 includes a pusher mechanism 316 coupled to the fence tracker 302 through a displacement track. The pusher mechanism can move using a tensioner with a wire attached to an anchor point, e.g. the front guard 308. The pusher mechanism 316 is configured to move within the product containment channel 310 along the displacement track to apply a constant substantially uniform force against the second product 314 and the first product 312 in the queue of products. As a result of the constant substantially uniform force applied by the pusher mechanism 316 the first product 312 is pushed towards the front guard 308 into a dispensing pocket 318 formed at least in part by the front guard 308. Once the first product 312 is dispensed from the dispensing pocket 318 a space exists between walls of the front guard 308 and the second product 314. As a result of the constant substantially uniform force applied by the pusher mechanism 108 to the second product 314, the second product 314 is displaced towards the front guard until it contacts the walls of the front guard 308 and can no longer move forward within the product containment channel 310. Further, once the second product 314 contacts the walls of the front guard 308 it is positioned in the dispensing pocket 318, where it can subsequently be conveniently dispensed.

Figure 4A:
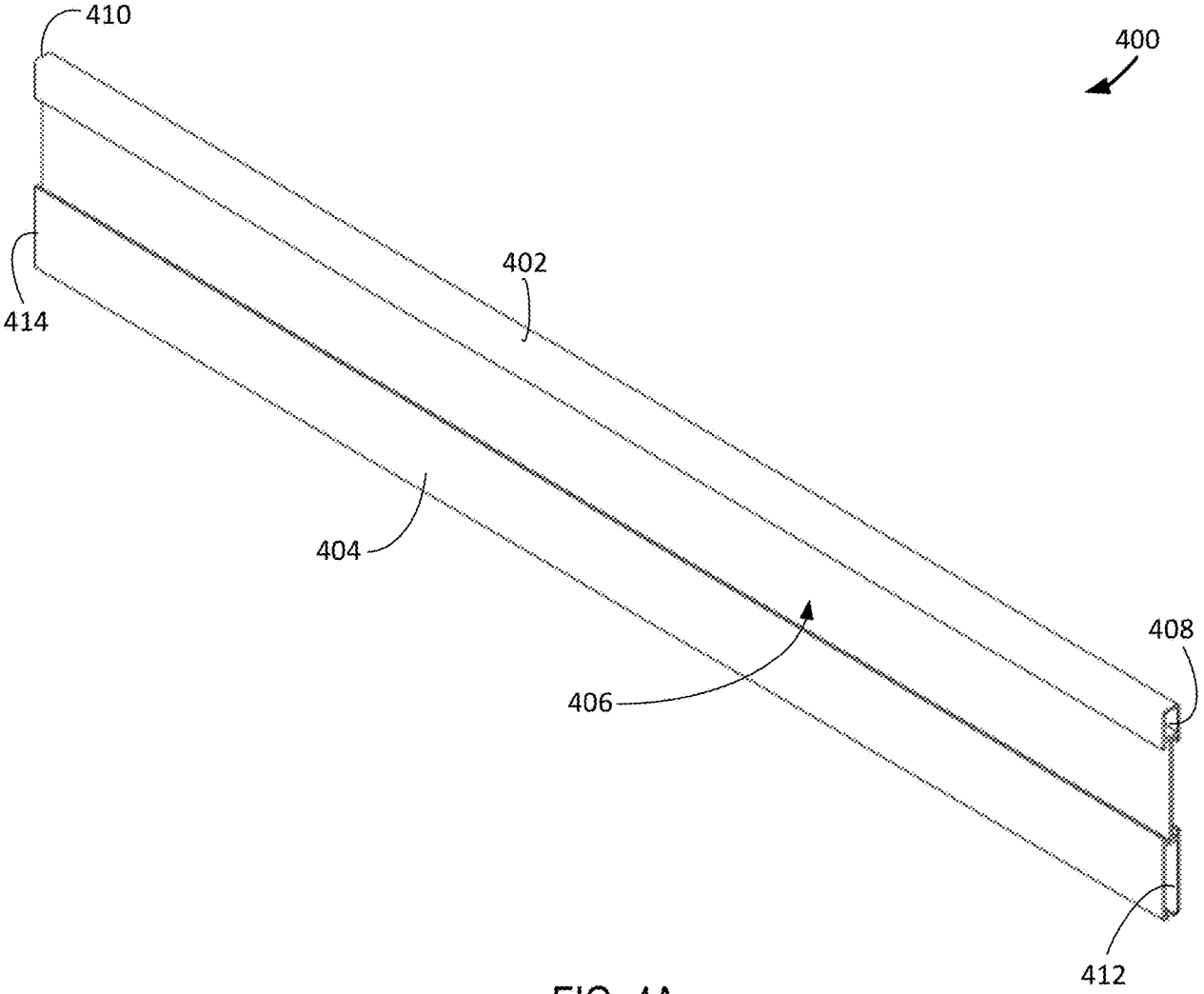
FIG. 4A depicts a side perspective view of a fence tracker.

FIG. 4A depicts a side perspective view 400 of a fence tracker. The fence tracker shown in FIG. 4A can be included as part of an applicable system for pushing products for purposes of dispensing products to consumers, such as the product pusher systems described in this paper. The fence tracker can be fabricated from a single continuous piece of material that is segmented into portions based on a desired length to form a plurality of fence trackers, including the fence tracker having the desired length. Additionally, the fence tracker can be fabricated from a metal, e.g. aluminum, to increase the strength of the fence tracker and reduce potential damage to the fence tracker caused in operation of dispensing products using the fence tracker.

The fence tracker shown in FIG. 4A includes an upper fin 402 and a lower fin 404. The upper fin 402 and the lower fin 404 act as runners forming a displacement track 406. The upper fin 402 and the lower fin 404 can function to provide structural stability to the fence tracker. Additionally, the displacement track 406 can be used to secure a pusher mechanism to the fence tracker. Additionally, a pusher mechanism can use either or both the upper fin 402 and the lower fin 404 to move within the displacement track 406. For example, a pusher mechanism can use either or both the upper fin 402 and the lower fin 404 to move within the displacement track 406 for purposes of securing products places in a product containment channel formed, at least in part, by the fence tracker. In another example, a pusher mechanism can use either or both the upper fin 402 and the lower fin 404 to move within the displacement track 406 for purposes of pushing products contained within a containment channel to a front cap in order to dispense the products. More specifically, the pusher mechanism can use either or both the upper fin 402 and the lower fin 404 to move within the displacement track 406 in order to constantly apply a substantially uniform force against one or a plurality of products contained within a product containment channel formed at least in part, by the fence tracker.

The upper fin 402 is hollow to create a forward upper opening 408 and a back upper opening 410. The lower fin 404 is hollow to create a forward lower opening 412 and a back lower opening 414. The forward upper opening 408 and the forward lower opening 412 can receive protrusions from a front guard to secure the front guard to the fence tracker. The back upper opening 410 and the back lower opening 414 can receive protrusions from a rear cap to secure the rear cap to the fence tracker. The fence tracker shown in FIG. 4 can have a length of between 20 and 21 inches and a height of 3 to 4 inches.

Figure 4B:
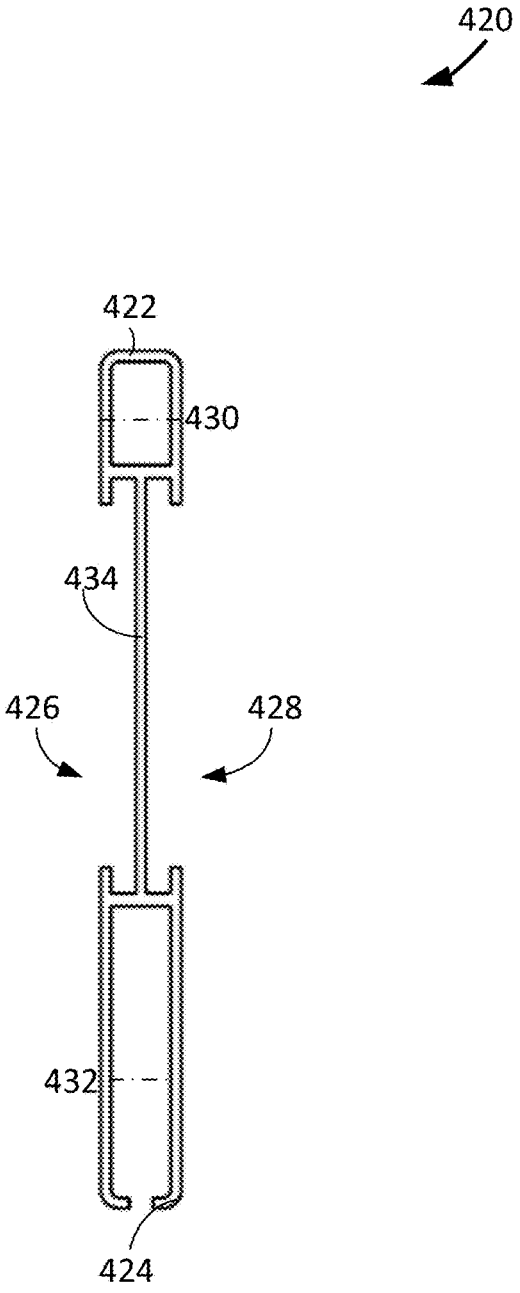
FIG. 4B depicts a cross sectional view of a fence tracker.

FIG. 4B depicts a cross sectional view 420 of a fence tracker. The fence tracker shown in FIG. 4B can be included as part of an applicable system for pushing products for purposes of dispensing products to consumers, such as the product pusher systems described in this paper. The fence tracker shown in FIG. 4B includes an upper fin 422 and a lower fin 424 that that form opposing displacement tracks 426 and 428. The upper fin 422 and the lower fin 424 can be hollow to create openings for receiving protrusions used in securing a rear cap and a front guard to the fence tracker. Either or both the upper fin 422 and the lower fin 424 can have a substantially uniform width 430 across the length of fins between 0.3 and 0.4 inches. Additionally, either or both the upper fin 422 and the lower fin 424 can have a substantially uniform opening width 432 across the length of the fins between 0.2 and 0.3 inches. The displacement tracks 426 and 428 can be formed through opposing sides of a wall 434 having a substantially uniform width across the length of the fence tracker between 0.03 and 0.05 inches. In having substantially uniform widths across the length of the fence tracker, overall strength and of the fence tracker is increased and smoothness of surfaces of the fence tracker is achieved leading to decreases in chances of mechanical failure. Substantially uniform widths and increased smoothness of surfaces can be achieved by fabricating the fence tracker from a single piece of a material, e.g. a single piece of Aluminum.

Figure 5A:
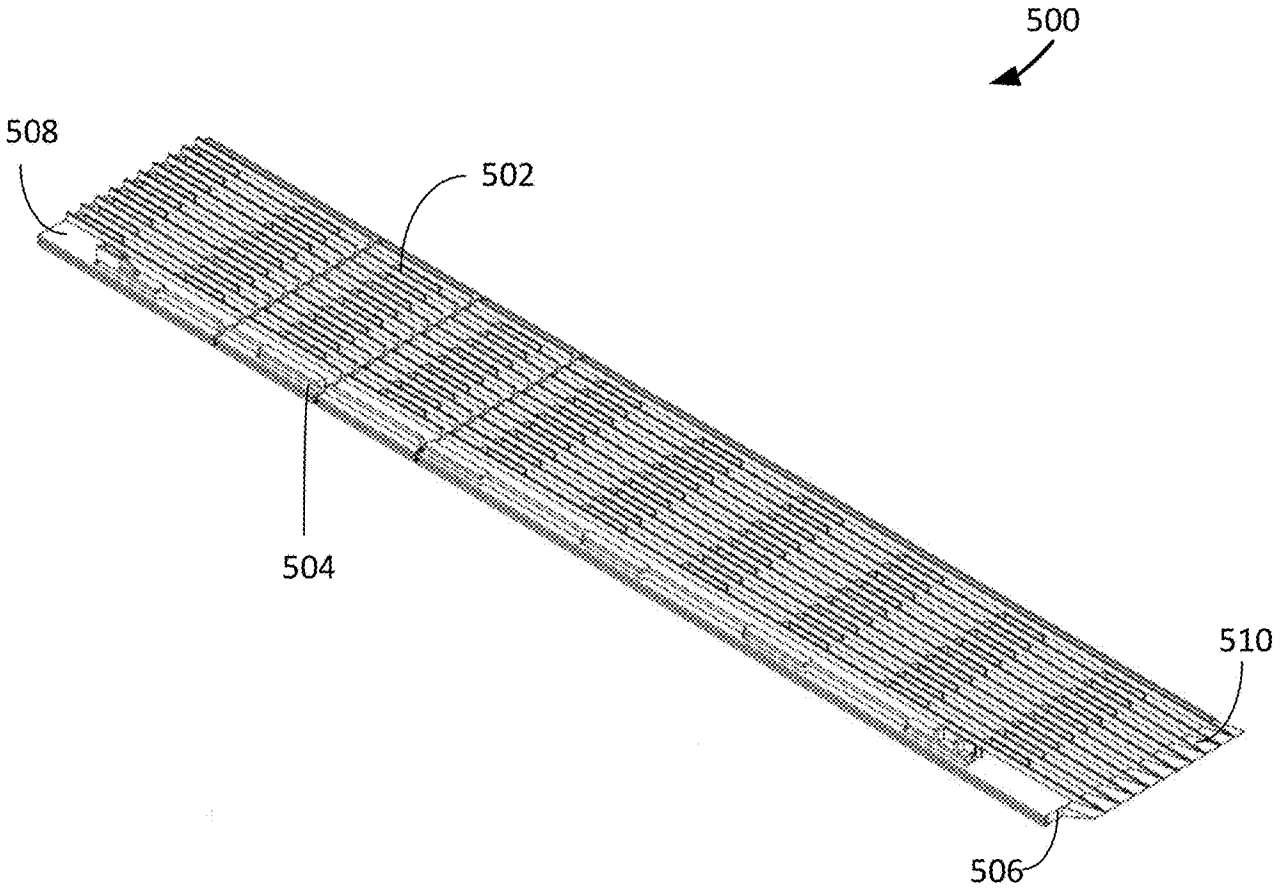
FIG. 5A depicts a top perspective view of a base track.

FIG. 5A depicts a top perspective view 500 of a base track. The base track shown in FIG. 5A can be included as part of an applicable system for pushing products for purposes of dispensing products to consumers, such as the product pusher systems described in this paper. The base track includes a top surface 502 upon which products contained within a product containment channel formed, at least in part, by the base track rest for purposes of being pushed and subsequently dispensed. The top surface 502 is corrugated. Utilizing a corrugated top surface 502 can decrease friction between contained products, thereby allowing the products to be pushed easily towards a front guard to dispense the products. Further, utilizing a corrugated top surface 502 can allow for removal or collection of moisture, e.g. condensation from temperature controlled products.

The base track includes tabs 504 that extend out from the top surface. The tabs 504 can match a corresponding hollow fin of a fence tracker for use in securing the fence tracker to the base track. For example, the tabs 504 can have dimensions matching an opening formed by a hollow fin and be slid into the opening of the hollow fin integrated as part of a fence tracker to physically couple the fence tracker to the base track. In securing a fence tracker to the base track using the tabs 504 and a corresponding hollow fin of the fence tracker, the base track and the fence tracer can combine to form, at least in part, a product containment channel used in containing and pushing products to dispense the products.

The base track includes a front alignment stop 506. The front alignment stop 506 is configured to engage a front guard secured to either or both a fence tracker and the base track and prevent the front guard from moving past the front alignment stop 506 and subsequently reducing a size of an overall product containment channel. The base track can also include a back alignment stop 508. The back alignment stop 508 is configured to engage a rear cap secured to either or both a fence tracker and the base track and prevent the rear cap from moving past the back alignment stop 508 and subsequently reducing a size of an overall product containment channel.

The front 510 of the base track can have a bottom that is sloped downward with respect to the top surface 502. The front 510 can have bottom surface angled at a slope corresponding to an angle at which a dispensing pocket of a front guard is sloped when coupled to the base track. This leads to mating friction between the bottom surface of the front of the base track 510 and the front guard while reducing the need for wrap around coupling between the front guard and the front 510 of the base track.

In a specific implementation, the base track shown in FIG. 5A is fabricated from an applicable flexible material. For example, the base track can be fabricated from a flexible plastic using an applicable plastic parts fabrication method. Additionally, the base track can be fabricated from an applicable light-weight material to allow for easier building, installation, transportation, configuring, and maintenance of a product pusher system utilizing the base track.

Figure 5B:
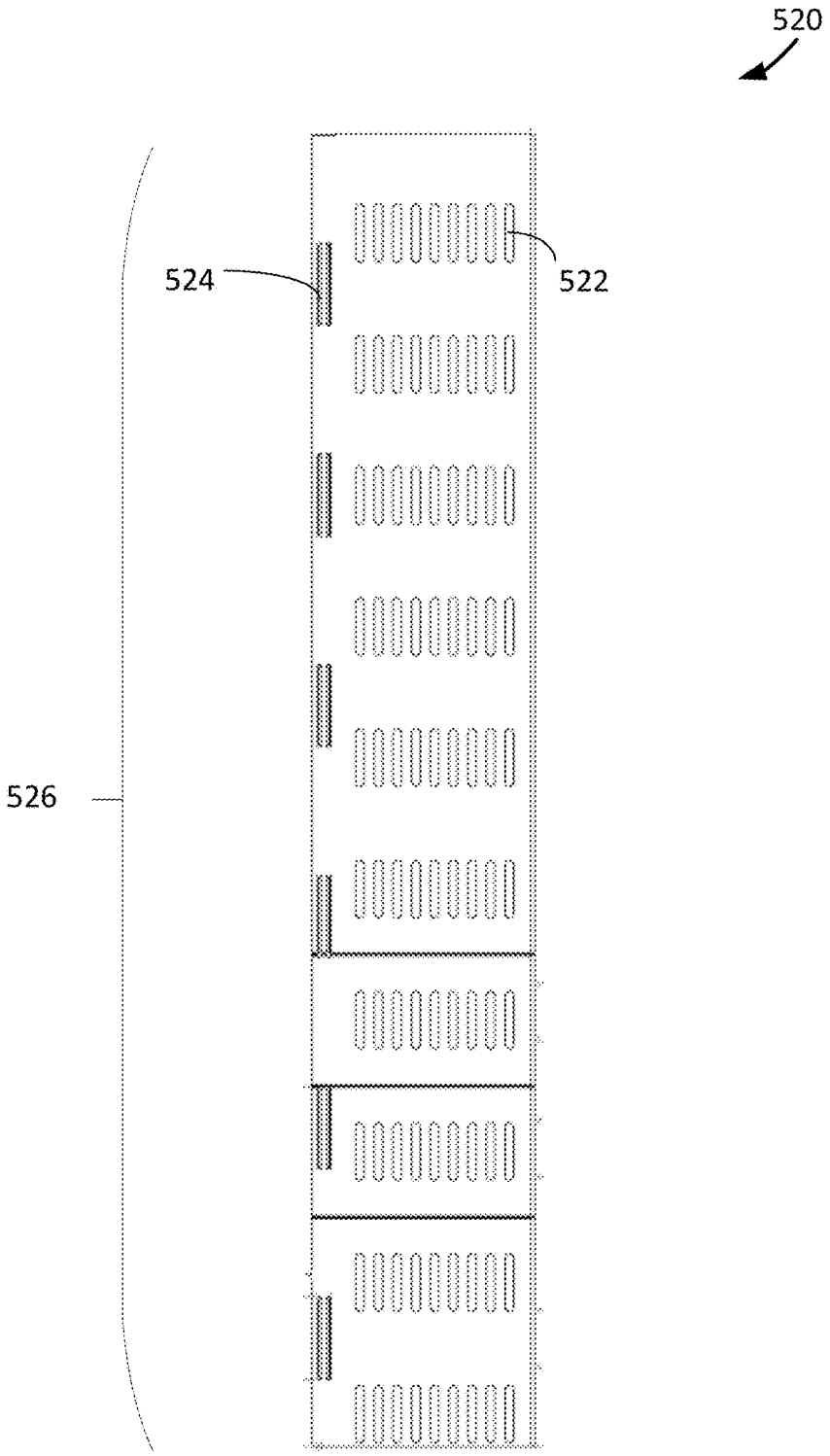
FIG. 5B depicts a top view of a base track.

FIG. 5B depicts a top view 520 of a base track. The base track shown in FIG. 5B can be included as part of an applicable system for pushing products for purposes of dispensing products to consumers, such as the product pusher systems described in this paper. The base track includes a plurality of trenches 522 that form, at least in part, a corrugated structured top surface of the base track. Additionally, the base track includes a plurality of tabs 524 extending out of the top surface of the base track. The tabs 524 can fit into an opening formed by a hollow fin of a fence tracker for purposes of securing the fence tracker to the base track. The tabs 524 can be positioned along a length 526 of the base track to ensure a fence tracker remains secured to the base track. The base track can have a length 526 between 20 and 21 inches.

Figure 5C:
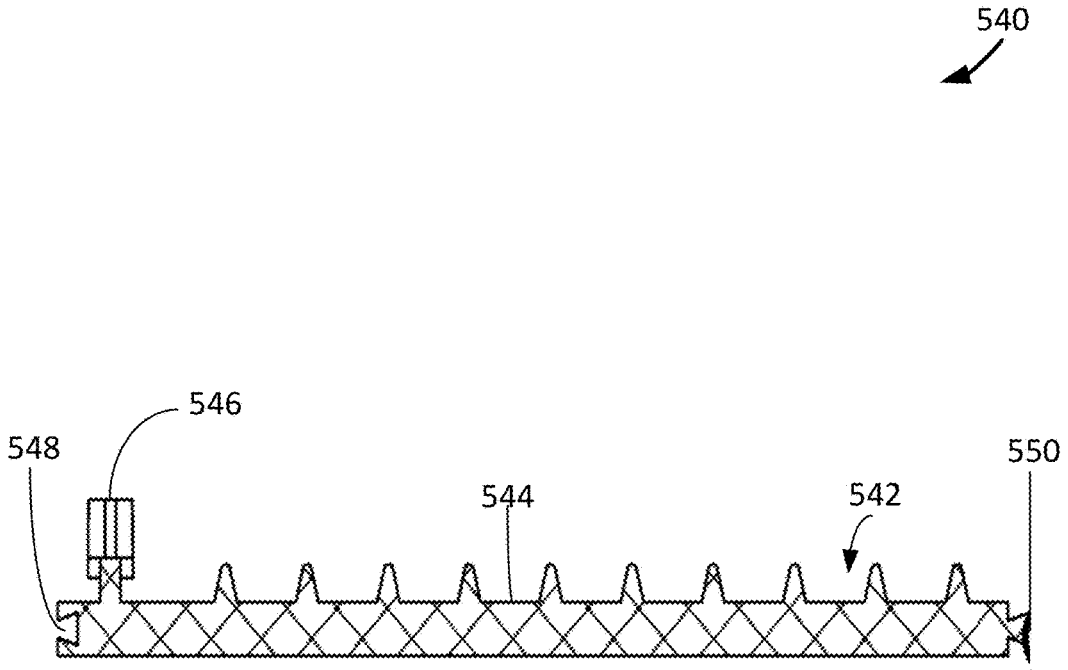
FIG. 5C depicts a cross sectional view of a base track.

FIG. 5C depicts a cross sectional view 540 of a base track. The base track shown in FIG. 5C can be included as part of an applicable system for pushing products for purposes of dispensing products to consumers, such as the product pusher systems described in this paper. The base track includes a plurality of trenches 542 that form a corrugated top surface 544 of the base track. The base track includes a plurality of tabs 546 extending out from the top surface 544 of the base track. The plurality of tabs can be used to secure a fence tracker to the base track. Additionally, the base track includes connectors 548 and 550 on opposing sides of the base track. The connectors 548 and 550 can be used to connect a plurality of base tracks together, for example, in constructing a product pusher system, or for purposes of shipping the base tracks as a single structure. The connectors 548 and 550 are shown as corresponding male and female physical fasteners, however, an applicable fastening mechanism can be utilized, e.g. magnets.

Figure 6:
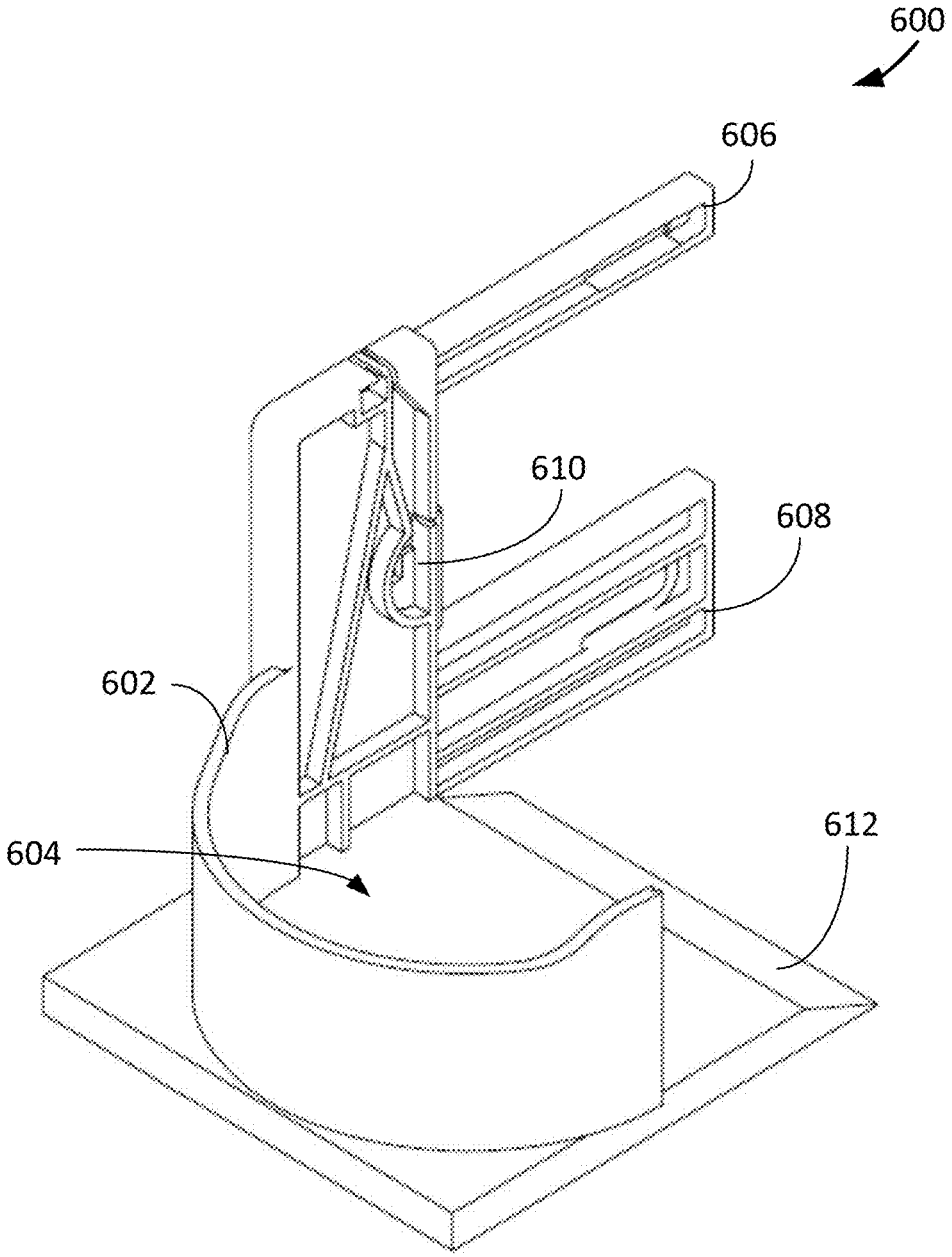
FIG. 6 depicts a perspective view of a rounded front guard.

FIG. 6 depicts a perspective view 600 of a front guard. The front guard shown in FIG. 6 can be included as part of an applicable system for pushing products for purposes of dispensing products to consumers, such as the product pusher systems described in this paper. The front guard shown in FIG. 6 includes a front wall 602 of an applicable size for exerting a force at a specific position on a product in order to stop movement of the product as it is being pushed for purposes of dispensing the product. For example, the front wall 602 can have a height of 1.5 inches, which is appropriate for stopping a 2-liter bottle of soda, which is typically about 12 inches tall. Products with wider bases and lower centers of gravity will tend to need less front wall height relative to products with narrower bases and higher centers of gravity.

FIG. 6 illustrates a dispensing pocket 604 defined at least in part by the front wall 602. In the example of FIG. 6, the dispensing pocket 604 has a rounded contour due to the front wall 602 having a rounded inner surface. (Where the front wall 602 forms a rounded inner surface, the front wall 602 can be referred to as having a rounded front wall that, in operation, conforms with a rounded surface of a product.) Advantageously, a rounded contour offers a more convenient dispensing pocket 604 for, e.g. columnar shapes, such as bottles and cans, that have rounded surfaces. The dispensing pocket 604 can be formed as part of a product containment channel for purposes of containing products in order to dispense the products. The front wall 602 can exert a force against, or otherwise stop products as they are pushed forward using an applicable pushing mechanism, such as the pusher mechanisms described in this paper. As a result, in operation, products are positioned within the dispensing pocket 604 for purposes of conveniently dispensing the product. For example, a front product in a queue of products can be pushed towards the front wall 602 which can subsequently apply a force to the front product to stop movement of the front product and cause the product to be contained within the dispensing pocket 604.

The front guard shown in FIG. 6 includes an upper protrusion 606 and a lower protrusion 608. The upper protrusion 606 and the lower protrusion 608 can be of a size and positioned to fit into openings formed by a corresponding upper fin and a lower fin of a fence tracker for purposes of securing the front guard to the fence tracker. In securing the front guard to a fence tracker, the front guard and the fence tracker can define, at least in part, a product containment channel for use in containing and pushing products to dispense the products.

The front guard shown in FIG. 6 includes an anchor point 610. The anchor point 610 can be used to secure a portion of a pusher mechanism for purposes of the pusher mechanism displacing products into the dispenser pocket 604. For example, the anchor point 610 can be used to secure a wire of a tensioner included as part of a pusher mechanism for purposes of pushing products by the pusher mechanism towards the front guard.

The front guard shown in FIG. 6 includes a mating surface 612 configured to come into contact with a base track. In the example of FIG. 6, the mating surface 612 is sloped with respect to a bottom front surface of a base track to provide mating friction between the base track and the front guard. As a result, the front guard can be secured, at least in part, through the mating friction between the mating surface 612 and a bottom front surface of the base track, without the use of wrap around coupling between the front guard and the base track.

In a specific implementation, the front guard shown in FIG. 6 is fabricated from an applicable flexible material. For example, the front guard can be fabricated from a flexible plastic using an applicable plastic parts fabrication method. Additionally, the front guard can be fabricated from an applicable light-weight material to allow for easier building, installation, transportation, configuring, and maintenance of a product pusher system utilizing the front guard.

Figure 7A:
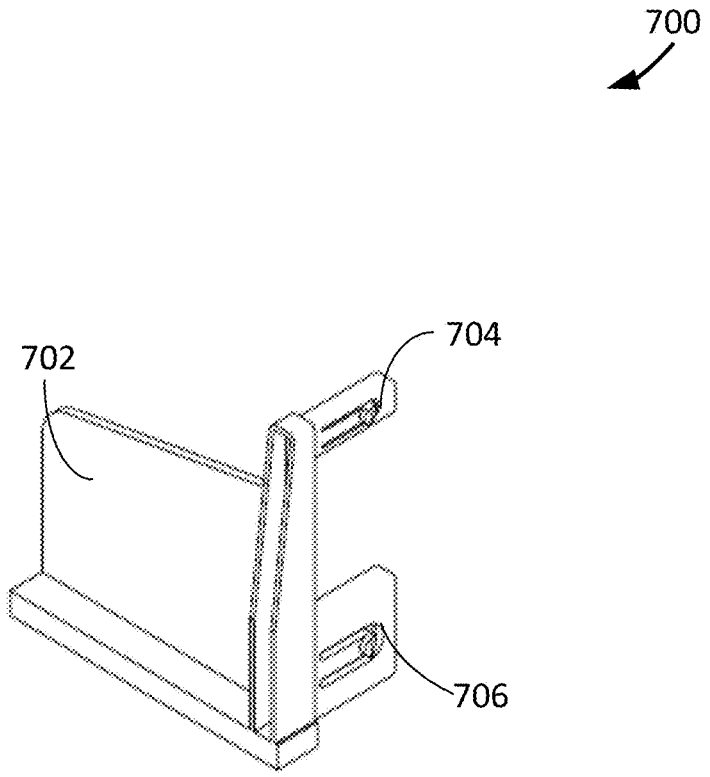
FIG. 7A depicts a perspective view of a rear cap.

FIG. 7A depicts a perspective view 700 of a rear cap. The rear cap shown in FIG. 7A can be included as part of an applicable system for pushing products for purposes of dispensing products to consumers, such as the product pusher systems described in this paper. The rear cap includes a stopping wall 702. The stopping wall 702 is configured to stop products contained within a product containment channel defined, at least in part, by the stopping wall 702. For example, the stopping wall 702 can stop products from falling out the back of a product containment channel. In another example, the stopping wall 702 can stop products from falling out the back of a product containment channel if a cable included as part of tensioner of a pusher mechanism is longer than a length of the product containment channel. The stopping wall 702 can have a varying height.

The rear cap includes an upper protrusion 704 and a lower protrusion 706. The upper protrusion 704 and the lower protrusion 706 can be of a size and positioned to fit into openings formed by a corresponding upper fin and a lower fin of a fence tracker for purposes of securing the rear cap to the fence tracker. In securing the rear cap to a fence tracker, the rear cap and the fence tracker can define, at least in part, a product containment channel for use in containing and pushing products to dispense the products.

In a specific implementation, the rear cap shown in FIG. 7A is fabricated from an applicable flexible material. For example, the rear cap can be fabricated from a flexible plastic using an applicable plastic parts fabrication method. Additionally, the rear cap can be fabricated from an applicable light-weight material to allow for easier building, installation, transportation, configuring, and maintenance of a product pusher system utilizing the rear cap.

Figure 7B:
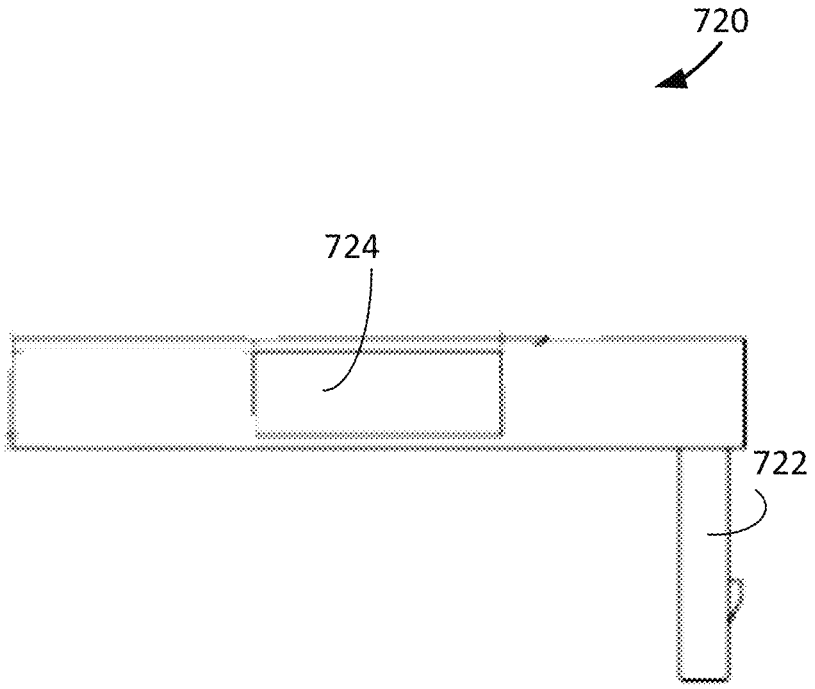
FIG. 7B depicts a bottom view of a rear cap.

FIG. 7B depicts a bottom view 720 of a rear cap. The rear cap shown in FIG. 7B can be included as part of an applicable system for pushing products for purposes of dispensing products to consumers, such as the product pusher systems described in this paper. The rear cap includes a lower protrusion 722 configured to secure the rear cap to a fence tracker. Additionally, the rear cap includes a cavity 724. The cavity 724 is configured to contain a magnet for use in removably securing the rear cap to a base track. In using a magnet to removably secure the rear cap to a base track, the rear cap can easily be attached to or detached from the base track depending on needs of an operator of a pusher system.

Figure 8A:
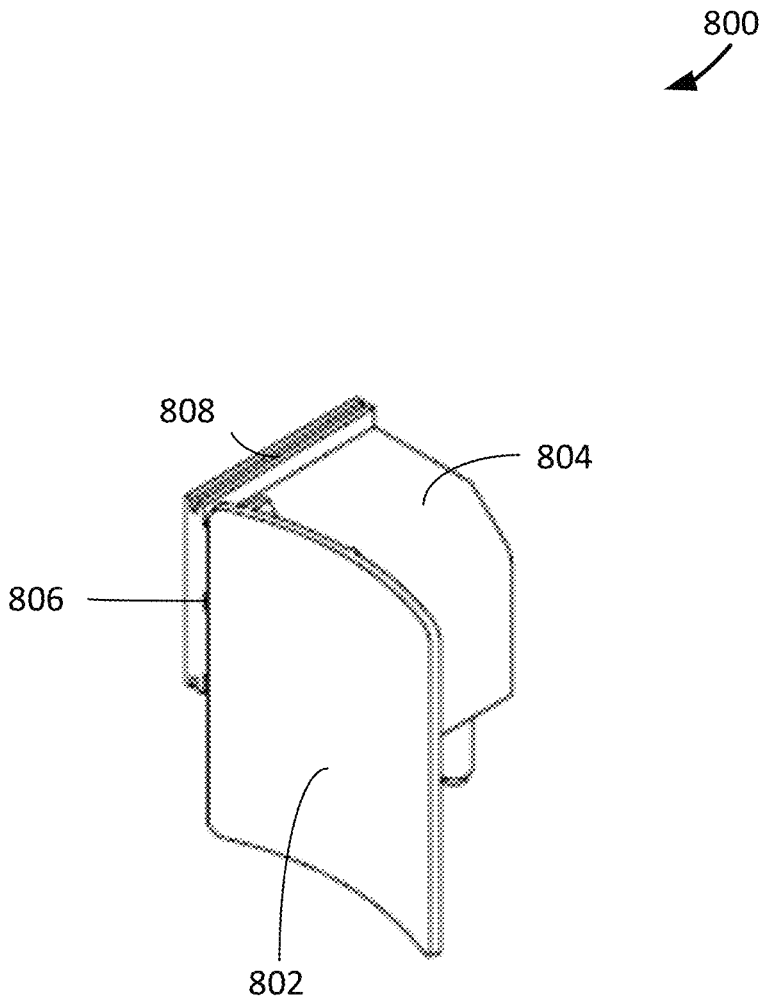
FIG. 8A depicts a perspective view of a pusher mechanism.

FIG. 8A depicts a perspective view 800 of a pusher mechanism. The pusher mechanism shown in FIG. 8A can be included as part of an applicable system for pushing products for purposes of dispensing products to consumers, such as the product pusher systems described in this paper. The pusher mechanism includes a pushing surface 802, a tensioner 804, and a bracket 808. The pushing surface 802 is configured to physically engage a product for purposes of applying a constant and substantially uniform force to the product. In the example of FIG. 8A, the pushing surface 802 is rounded. (Where the pushing surface 802 is rounded, the pushing surface 802 can be referred to as having a rounded back wall that, in operation, conforms with a rounded surface of a product.)

The tensioner 804 is configured to generate a constant and substantially uniform force that can be applied to a product for purposes of pushing the product to dispense the product.

The tensioner 804 includes an opening 806 out of which a coiled wire can extend for affixing to an anchor point, e.g. on a front guard.

The bracket 808 is configured to secure the pusher mechanism to a fence tracker in a displacement track integrated as part of the fence tracker. The pusher mechanism can utilize the bracket 808 to move along the displacement track for purposes of pushing products to be dispensed in a product containment channel. For example, the pusher mechanism can move along the displacement track towards a front guard to push products toward the front guard, where the products can subsequently be dispensed. The tensioner 804 can drive movement of the product pusher along the displacement track to cause the pushing surface 802 to apply a constant substantially uniform force to a product contained in the product containment channel.

Figure 8B:
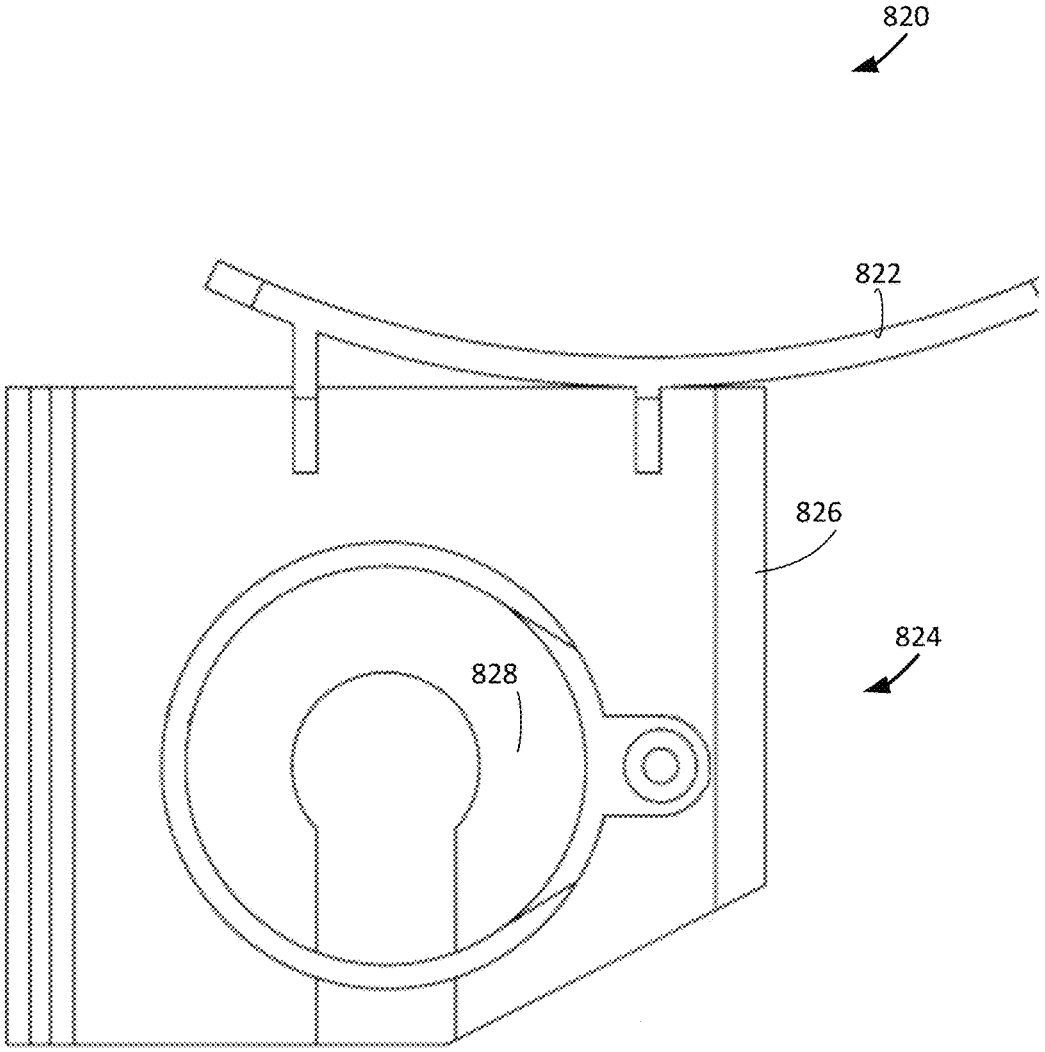
FIG. 8B depicts a cross sectional view of a pusher mechanism.

FIG. 8B depicts a cross sectional view 820 of a pusher mechanism. The pusher mechanism shown in FIG. 8B can be included as part of an applicable system for pushing products for purposes of dispensing products to consumers, such as the product pusher systems described in this paper. The pusher mechanism shown in FIG. 8B includes a pushing surface 822 and a tensioner 824. The pushing surface is configured to physically engage a product and apply a constant substantially uniform force generated by the tensioner 824 to the product. The tensioner 824 includes a housing 826 that contains a coil of wire 828. The coil of wire 828 is attached to an anchor point and is used to cause the pusher mechanism to move along a displacement track. The coil of wire 828 can cause the pusher mechanism to move along the displacement track as part of applying a constant substantially uniform force to a product as the product is pushed towards a front guard. The pushing surface 822 and the housing 826 can be fabricated of a lightweight flexible material, e.g. a plastic.

Figure 9A:
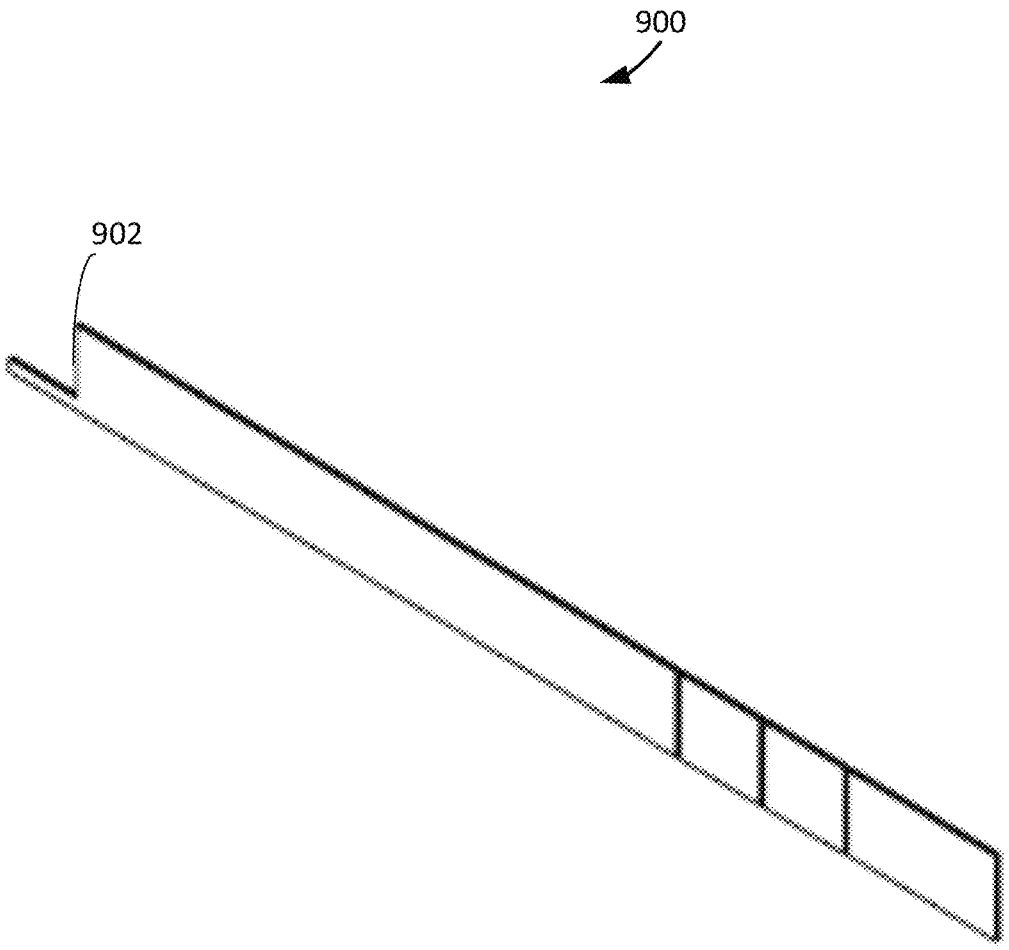
FIG. 9A depicts a perspective view of an end fence.

FIG. 9A depicts a perspective view 900 of an end fence. The end fence shown in FIG. 9A can be included as part of an applicable system for pushing products for purposes of dispensing products to consumers, such as the product pusher systems described in this paper. The end fence can define, at least in part, a product containment channel for use in containing and pushing products to dispense the products. More specifically, the end fence can be coupled to one or a combination of a base track, a rear cap, and a front guard, to define, at least in part, a product containment channel with the base track, the rear cap, and the front guard. The end fence includes a front edge 902 configured to physically contact a front wall of a front guard when the end fence is assembled within a product pusher system. In including a front edge 902 that physically contacting a front wall of a front guard, the end fence can define, along with the front wall of the front guard, a dispensing product capable of containing a product to be dispensed.

In a specific implementation, the end fence shown in FIG. 9A is fabricated from an applicable flexible material. For example, the end fence can be fabricated from a flexible plastic using an applicable plastic parts fabrication method. Additionally, the end fence can be fabricated from an applicable light-weight material to allow for easier building, installation, transportation, configuring, and maintenance of a product pusher system utilizing the end fence.

Figure 9B:
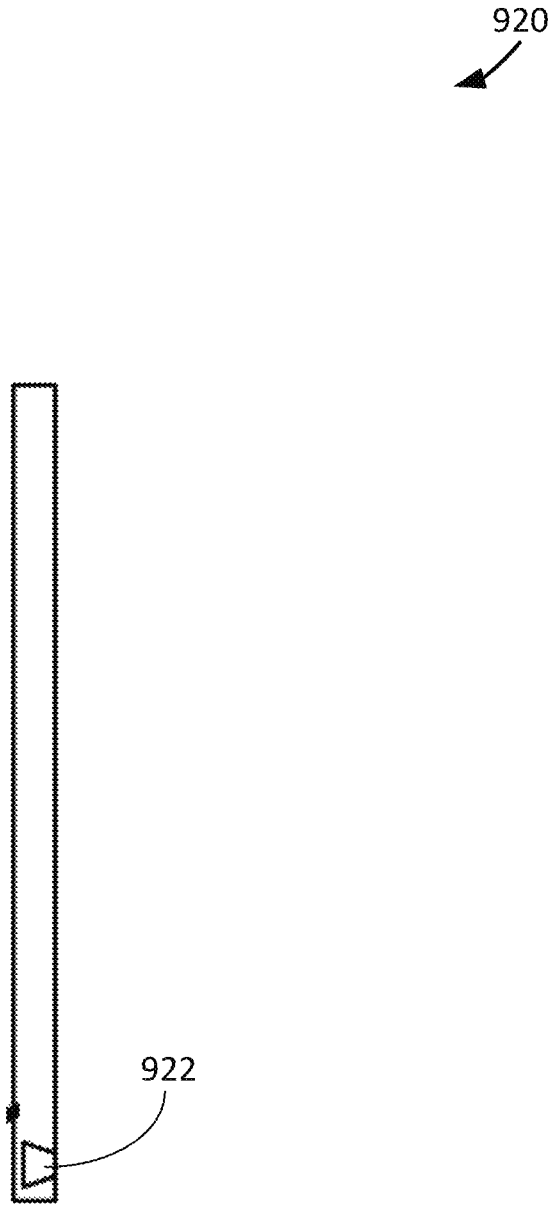
FIG. 9B depicts a cross sectional view of an end fence.

FIG. 9B depicts a cross sectional view 920 of an end fence. The end fence shown in FIG. 9B can be included as part of an applicable system for pushing products for purposes of dispensing products to consumers, such as the product pusher systems described in this paper. The end fence includes a fastener 922 used to couple the end fence to a base track. The fastener 922 can include an applicable mechanism for coupling two pieces of material together. For example, the fastener 922 can include a fitted opening for connecting a protrusion of a base track and subsequently the base track to the end fence.

Figure 10:
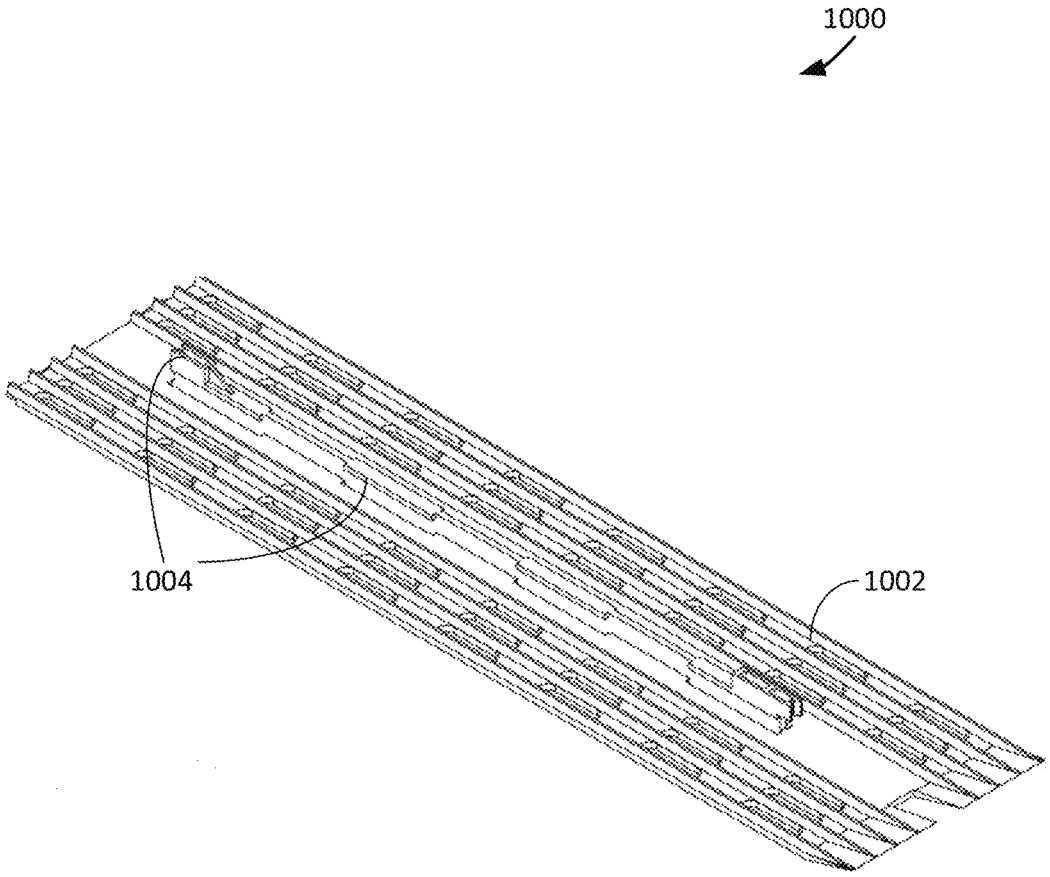
FIG. 10 depicts a perspective view of another base track.

FIG. 10 depicts a perspective view 1000 of another base track. The base track shown in FIG. 10 can be included as part of an applicable system for pushing products for purposes of dispensing products to consumers, such as the product pusher systems described in this paper. The base track includes a top surface 1002 and is used to define, at least in part, two adjacent product containment channels. The base track includes protrusions 1004 that extend out from the top surface and are used to couple a fence tracker to the base track in forming two adjacent product containment channels.

In a specific implementation, the base track shown in FIG. 10 is fabricated from an applicable flexible material. For example, the base track can be fabricated from a flexible plastic using an applicable plastic parts fabrication method. Additionally, the base track can be fabricated from an applicable light-weight material to allow for easier building, installation, transportation, configuring, and maintenance of a product pusher system utilizing the base track.

Figure 11:
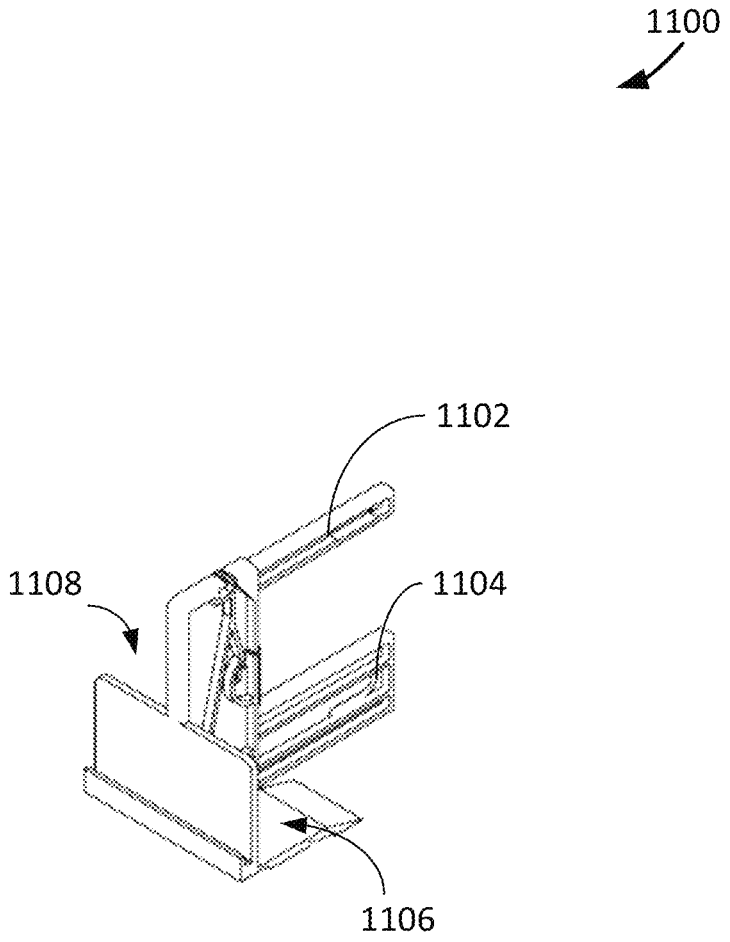
FIG. 11 depicts a perspective view of another front guard.

FIG. 11 depicts a perspective view 1100 of another front guard. The front guard shown in FIG. 11 can be included as part of an applicable system for pushing products for purposes of dispensing products to consumers, such as the product pusher systems described in this paper. The front guard includes an upper protrusion 1102 and a lower protrusion 1104 extending out of the center of the front guard that are used to attach the front guard to a fence tracker. The front guard can define, at least in part, adjacent first and second dispensing pockets 1106 and 1108 that form part of adjacent product containment channels.

In a specific implementation, the front guard shown in FIG. 11 is fabricated from an applicable flexible material. For example, the front guard can be fabricated from a flexible plastic using an applicable plastic parts fabrication method. Additionally, the front guard can be fabricated from an applicable light-weight material to allow for easier building, installation, transportation, configuring, and maintenance of a product pusher system utilizing the front guard. The height of the front guard can be adjusted as appropriate, such as having a one inch height when dispensing small boxes or a two inch height when dispensing packages of diapers (a product that is known to be relatively difficult to load and dispense, and which is more amenable to stocking when using techniques described in this paper).

Figure 12:
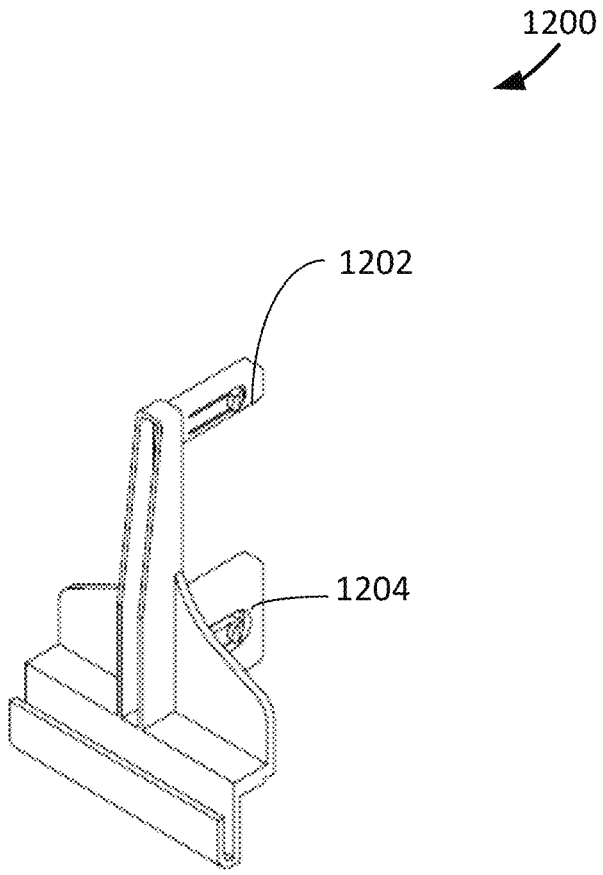
FIG. 12 depicts a perspective view of another rear cap.

FIG. 12 depicts a perspective view 1200 of another rear cap. The rear cap shown in FIG. 12 can be included as part of an applicable system for pushing products for purposes of dispensing products to consumers, such as the product pusher systems described in this paper. The rear cap includes an upper protrusion 1202 and a lower protrusion 1204 that extend out form the center of the rear cap. The upper protrusion 1202 and the lower protrusion 1204 are used to attach the rear cap to a fence tracker. The rear cap can define, at least in part, adjacent product containment channels.

In a specific implementation, the rear cap shown in FIG. 12 is fabricated from an applicable flexible material. For example, the rear cap can be fabricated from a flexible plastic using an applicable plastic parts fabrication method. Additionally, the rear cap can be fabricated from an applicable light-weight material to allow for easier building, installation, transportation, configuring, and maintenance of a product pusher system utilizing the rear cap.

These and other examples provided in this paper are intended to illustrate but not necessarily to limit the described implementation. As used herein, the term "implementation" means an implementation that serves to illustrate by way of example but not limitation. The techniques described in the preceding text and figures can be mixed and matched as circumstances demand to produce alternative implementations.

We claim:

1. A system comprising:

a base track including a top surface for supporting a queue of products;

a rear cap;

a front guard having an anchor point;

a fence tracker physically connectable to the rear cap, the front guard, and the base track, the fence tracker, the rear cap, the front guard and the base track defining a product containment channel for the queue of products, the fence tracker including an upper fin disposed along an upper longitudinal portion of the fence tracker and including a lower fin disposed along a lower longitudinal portion of the fence tracker, the upper fin and the lower fin spaced apart by a predetermined distance, the upper fin and the lower fin defining a displacement track extending along a longitudinal length of the fence tracker;

a pusher mechanism including a pushing surface, a bracket and a tensioner, the tensioner including an opening in front of the bracket from which a coiled wire extends within the displacement track and connects to the anchor point of the front guard, the bracket being sized to fit and configured to slideably move within the displacement track defined by the upper fin and the lower fin, the coiled wired configured to apply a uniform and substantially constant force to the pusher mechanism towards the front guard, thereby causing the pushing surface to apply the uniform and substantially constant force to the queue of products towards the front guard, the coiled wire configured to ensure that the uniform and substantially constant force will not move the queue of products toward the front guard at a velocity greater than 30.5 centimeters per second.

2. The system of claim 1, further comprising:

a plurality of base tracks, a plurality of fence trackers, a plurality of rear caps, and a plurality of front guards coupled to each other to define a plurality of product containment channels for use in containing a plurality of queues of products to be dispensed;

a plurality of corresponding pusher mechanisms in the plurality of product containment channels configured to simultaneously apply uniform and substantially constant forces to the plurality of queues of products.

3. The system of claim 1, wherein the fence tracker is fabricated from a single piece of metal.

4. The system of claim 1, wherein the upper fin of the fence tracker includes a first front opening and the lower fin of the fence tracker includes a second front opening, and the first front opening is configured to receive an upper protrusion of the front guard and the second front opening is configured to receive a lower protrusion of the front guard to secure the fence tracker to the front guard.

5. The system of claim 1, wherein the upper fin of the fence tracker includes a first back opening and the lower fin of the fence tracker includes a second back opening, and the first back opening is configured to receive an upper protrusion of the rear cap and the second back opening is configured to receive a lower protrusion of the rear cap to secure the fence tracker to the rear cap.

6. The system of claim 1, wherein the base track is coupled to the fence tracker through a plurality of protrusions that extend out from the base track.

7. The system of claim 1, wherein the base track is coupled to the fence tracker through a plurality of protrusions that extend out from the base track along a middle of the base track, the fence tracker and the base track coupled together to form adjacent product containment channels.

8. The system of claim 1, wherein the lower fin of the fence tracker forms an opening that extends along the length of the fence tracker and the base track includes a plurality of protrusions that extend out of the top surface of the base track and are configured to fit within the opening to secure the fence tracker to the base track.

9. The system of claim 1, wherein the tensioner is positioned to cause the coiled wire to extend along the fence tracker as the pusher mechanism moves along the displacement track.

10. The system of claim 1, wherein the top surface of the base track is corrugated.

11. The system of claim 1, wherein the rear cap, the front guard, and the base track are fabricated from a flexible plastic material.

12. The system of claim 1, wherein the product containment channel has a depth of between 18 and 22 inches.

13. The system of claim 1, wherein the product containment channel has depth of between 30 and 40 inches.

14. The system of claim 1, wherein the fence tracker has a substantially consistent wall thickness across the length of the fence tracker.

15. The system of claim 1, wherein a bottom front surface of the base track is sloped at an angle corresponding to an angle at which dispensing product of the front guard is sloped in order to provide mating friction between the base track and the front guard.

16. The system of claim 1, wherein the uniform and substantially constant force is applied to the queue of products to prevent a product in the queue of products from being accelerated into the front guard at a velocity greater than 15 centimeters per second.

17. The system of claim 1, further comprising a cavity on the bottom of the rear cap including a magnet to couple the rear cap to the base track.

18. The system of claim 1, wherein the base track includes a front alignment stop configured to engage the front guard and prevent the front guard from moving past the front alignment stop into the product containment channel.

19. The system of claim 1, wherein the base track includes a back alignment stop configured to engage the rear cap and prevent the rear cap from moving past the back alignment stop into the product containment channel.

* * * * *